US006684586B1

(12) United States Patent
Hoffmann, Sr.

(10) Patent No.: US 6,684,586 B1
(45) Date of Patent: Feb. 3, 2004

(54) DRYWALL FINISHING STRIP

(75) Inventor: Dennis Hoffmann, Sr., McHenry, IL (US)

(73) Assignee: Pro Patch Systems, Inc., McHenry, IL (US)

( * ) Notice: Subject to any disclaimer, the term of this patent is extended or adjusted under 35 U.S.C. 154(b) by 0 days.

(21) Appl. No.: 09/306,493

(22) Filed: May 6, 1999

(51) Int. Cl.[7] ..... E04F 19/04
(52) U.S. Cl. ..... 52/255; 52/287.1
(58) Field of Search ..... 52/255, 254, 287.1, 52/288.1

(56) References Cited

U.S. PATENT DOCUMENTS 1,167,837 A * 1/1916 Pride ..... 52/250
1,608,475 A * 11/1926 Dean ..... 52/255
3,914,521 A * 10/1975 Beatty et al. ..... 156/272.6
4,313,991 A * 2/1982 Lamb ..... 428/131
4,977,718 A * 12/1990 Hoffman, Sr. ..... 52/288
5,409,754 A * 4/1995 Yasuda et al. ..... 428/43
5,627,376 A * 5/1997 Jaisinghani et al. ..... 250/324
5,663,033 A * 9/1997 Warner et al. ..... 430/253
5,778,617 A * 7/1998 Free ..... 52/255
5,813,179 A * 9/1998 Koenig, Jr. et al. ..... 52/255
6,070,374 A * 6/2000 Bifano et al. ..... 52/86

* cited by examiner

*Primary Examiner*—Brian E. Glessner
(74) *Attorney, Agent, or Firm*—David I. Roche; Baker & McKenzie

(57) ABSTRACT

A strip of polymer material is used as a corner bead or drywall tape. In a preferred application, the location, i.e. a joint, where two pieces of drywall meet are sprayed with an adhesive and the strip is put in place over the joint. Then, drywall compound is placed over the strip and finished by a drywall finisher. Perforations, depressions and knurling on the strip allow drywall compound to form, when dry, a mechanical bond to the strip at the joint. The material used to make the strip is preferably a mineral filled polymer, such as talc-filled polypropylene, which is inexpensive and light-weight. The adhesive applied to the joint is preferably one which is specially formulated to bond to polypropylene. The strip is initially extruded into a flat form and a crease is imparted to the center of the strip. This allows the strip to be carried in a compact, rolled form. The mineral filling used in the formulation of the polymer comprising the strip enables gypsum and water based drywall compound to adhere very well to the strip so that a long lasting, high quality joint in a drywall construction can be formed.

9 Claims, 2 Drawing Sheets

DRYWALL FINISHING STRIP

BACKGROUND AND SUMMARY OF THE INVENTION

The present invention is directed to a strip for use in construction and repair of surfaces made from drywall. Drywall, which is sometimes referred to as wallboard, is a gypsum-based sheet with heavy paper on the outside surfaces thereof. Drywall is a very common construction material used primarily on interior walls and, sometimes, ceilings. The drywall sheets generally come in panels which are 4 feet×8 feet. As such, it is necessary to form various joints at the edges of the panels. Such joints typically include butt joints where panels lying in the same plane abutt one another, and 90 degree corner joints, both internal and external. Where such joints occur, an installer will typically use paper tape or corner bead as needed.

The prior art includes a wide variety of corner bead and paper tape products. For example, U.S. Pat. No. 5,037,686, and related patents, shows various versions of a drywall tape which is made of plastic and which is suggested for use at various angled and non-angled joints. Another patent to the same inventor, U.S. Pat. No. 4,418,027 shows an improved PVC (polyvinylchloride tape) in which the ability of the PVC strip to adhere to taping compound is enhanced by gluing cotton or synthetic fibers to the surface of the PVC tape. The use of glue to attach a floc as is shown and suggested in the '027 patent is expensive and difficult, which makes the end product, a product sold under the trademark STRAITFLEX by Con-Form International, Inc., expensive. Because it is itself a laminated product, a drywall strip with floc glued to it to enhance the adhesion of drywall compound to the strip are subject to delamination, particularly when drywall compound, as opposed to a mechanical method such as nailing or stapling, is used to connect the strip to a piece of drywall. Other examples of prior art devices used at the joints of drywall include the products of vinyl corporation in Miami, Fla. Such products are shown, for example, in U.S. Pat. Nos. 5,138,810 and 5,003,743. These products are extruded vinyl forms which are not intended to be flexible enough to ship in a flattened and rolled form.

Yet another example of a prior art device for use in forming joints in drywall construction is shown in U.S. Pat. Nos. 4,977,718 and 4,835,925, which are patents of the Assignee of this invention. These patents show a perforated vinyl strip with a central hinge allowing the strip to be shipped as a roll and formed into a 90 degree angle on site by a drywall installer. While the '718 patent suggests that the strip may be formed of a polypropylene polymer, vinyl is indicated as the preferred material used to form the strip. Polypropylene, however, is a material to which drywall compound and other construction adhesives do not adhere well. It is of utmost importance that gypsum-based drywall compound, which is used to form and finish joints in drywall construction, adhere well to the strip which is used to bridge the joint either in a butt joint or a corner joint.

The prior art also includes products of the company called Trim-tex, Inc., of Lincolnwood, Ill. U.S. Pat. Nos. 5,752,353 and 5,313,755 show examples of some of the products of Trim-tex, one of which is sold under the name MAGIC CORNER, which is also a vinyl material which includes a corner bead made of two apparently co-extruded materials, a soft flexible PVC in the center and a more rigid PVC at the outer edges. Further information regarding the Trim-tex products can be seen at the web site of Trim-Tex, which is at www.trim-tex.com.

Finally, perhaps the most common device used in drywall construction is a simple galvanized corner bead. The galvanized steel material is preformed into a 90 degree angled shape and generally has perforations. While in common use, the galvanized corner bead suffers from the same difficulty as does the extruded 90 degree angle PVC corner bead, in that they both are bulky and difficult to transport by virtue of the fact that they are preformed into a 90 degree angle shape at the factory.

The present invention allows the manufacture of a low-cost, yet highly effective device for use in forming joints in drywall construction. A mineral filled polypropylene material, which may be extruded into sheet form of very wide widths or into individual strips, is embossed with a simple crease down the center of the strip. The crease may be formed by squeezing the center of the strip between rollers, one of which rollers has narrow protrusion and another has a groove, with the protrusion and groove being aligned. Along with the formation of the crease, the strip is perforated and knurled to increase the surface area and to facilitate the ability of construction adhesives and drywall compound to adhere to the surface of the strip. By using mineral fill instead of plain polypropylene, the strip of the present invention has excellent adhesive characteristics, i.e. drywall compound, printing inks and construction adhesives in general adhere very well to it. Further, in accordance with the invention, an adhesive, preferably applied by spraying, is used to first attach the strip to the drywall sheets being joined. An adhesive particularly suited for use in bonding to polypropylene enables the strip to be firmly fixed to the drywall. Once the strip has been properly positioned, a drywall finisher can then apply drywall compound the finish the joint. The perforations and knurling of the strip of the present invention permit the forming of an excellent bond between the strip and the drywall compound. As used herein, the term "adhesives" is intended to include sprayed adhesives, adhesives dispensed from a tube with a caulking gun, and drywall compound in pre-mixed or dry form.

The foregoing features and advantages of the present invention are shown and explained in the following text and drawings, wherein:

THE DRAWINGS

DETAILED DESCRIPTION OF AN EMBODIMENT OF THE INVENTION

Figure 1:
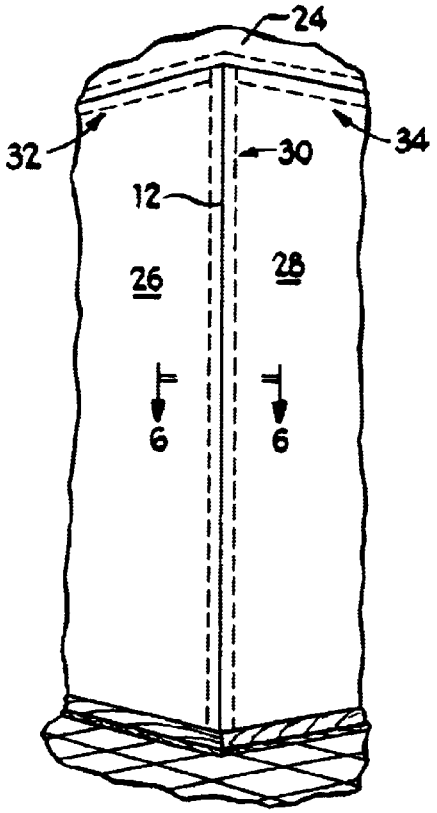
FIG. 1 is an elevational view of a corner formed by two sheets of drywall suitable for joining by use of a strip of the present invention;.

Referring now to the drawings in detail, and more particularly to FIG. 1, a first sheet of drywall 26 is shown adjacent to a second sheet of drywall 28 to form an outside corner 30. The ceiling 24 shown in FIG. 1, also formed by a sheet of drywall, forms inside corners 32 and 34 at the junction with the first and second drywall sheets 26 and 28, respectively.

Figure 3:
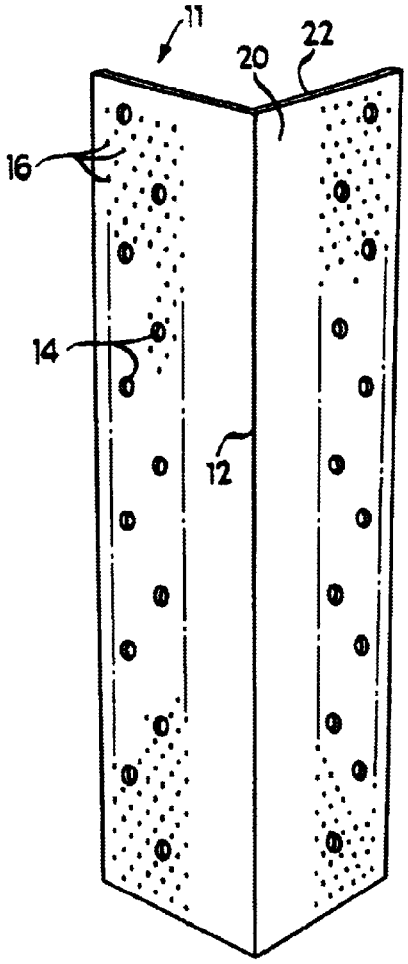
FIG. 3 is a perspective view of a segment of a strip of the present invention bent into a 90 degree angle.
Figure 2:
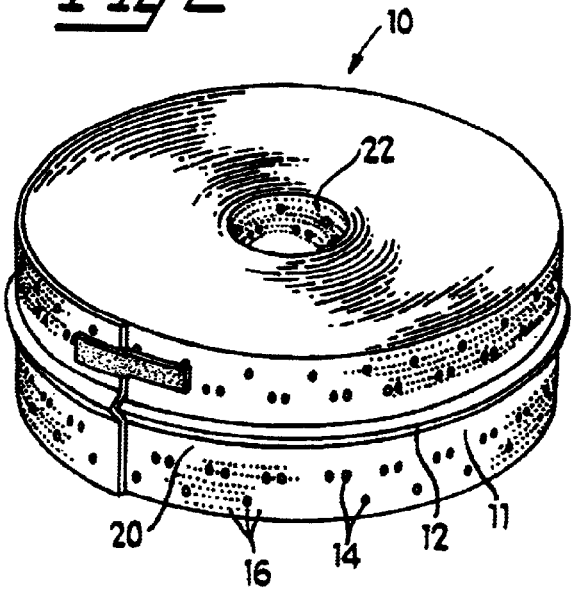
FIG. 2 is a perspective view of a roll of material made in accordance with the present invention.

FIG. 2 shows a roll 10 of the strip 11 of the present invention. Also shown in FIG. 2 are the small depressions 16 and larger perforations 14 on the outer portions of the surface of the strip 11 shown in FIG. 2. The crease 12 is shown as projecting outwardly from the surface shown in FIG. 2. As can be seen in FIG. 3, the strip 11 has been bent along the longitudinal crease 12 to an angle of about 90 degrees. The outside surface 20 shown in FIGS. 2 and 3 is a surface from which the crease 12 projects outwardly. In contrast, the inside surface 22 of the strip 11 is a surface in which the crease 12 is an indentation. The direction in which the crease 12 extends from the strip 11 suggests that the installer should place the inside surface 22 against the surfaces of the drywall sheets 26 and 28 after the strip has been bent to the 90 degree shape shown in FIG. 3.

Figure 4:
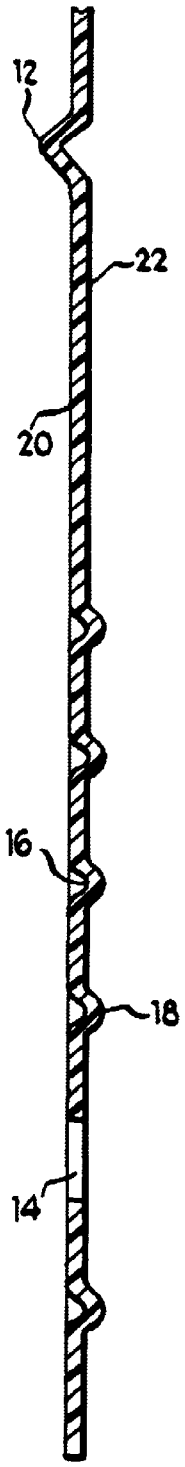
FIG. 4 is a partial cross-sectional view of a strip of the present invention in flat form.
Figure 5:
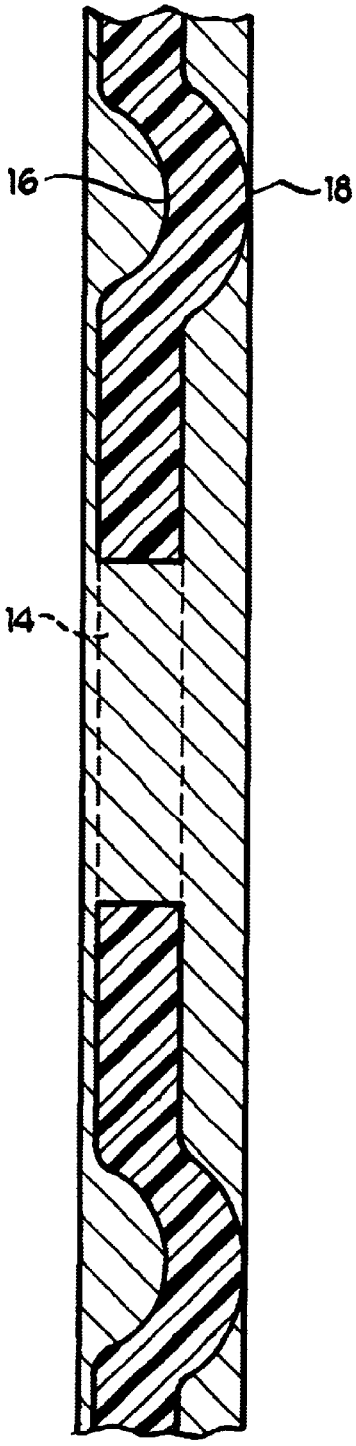
FIG. 5 is an enlarged partial cross-sectional view of a perforated portion of a strip of the present invention in an installed condition.
Figure 6:
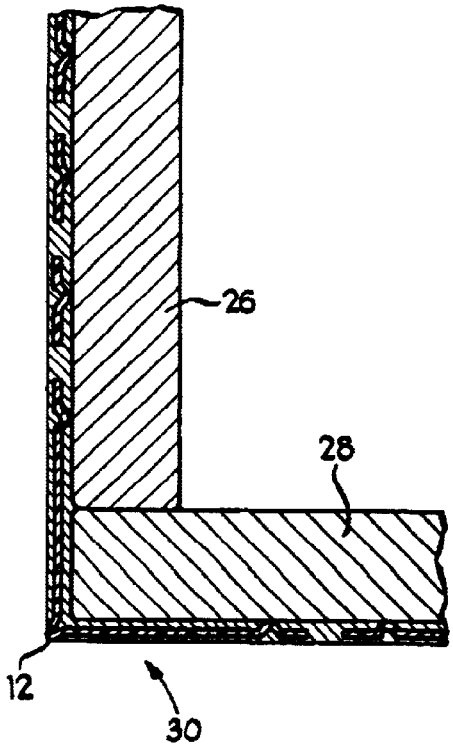
FIG. 6 is a cross-sectional view taken along line 6—6 of FIG. 1.

As can be seen most clearly in FIGS. 4 and 5, the depressions 16 have complementary knurls 18 formed on the inside surface 22 of the strip 11. The perforations 14 extend from one surface of the strip to the other. The perforations 14 are shown in a staggered pattern in FIG. 3 extending along the outer portion of each side of the strip 11. It should be noted that the relative size of the thickness of the strip 11 and the depth and height of the depressions 16 and knurls 18 is not to scale, as shown in the Figures. However, as an example of the spacing and height, the depressions and knurls may be approximately 0.005 inches in height and depth, respectively, on a strip having a thickness of about 0.025 inches. The perforations 14 may be spaced at approximately half-inch intervals along the length of the strip with the outer row of perforations 14 being approximately one-quarter inch from the edge of the strip 11, and the inner row being approximately one-half inch from the edge of the strip 11. The diameter of the perforations 14 is preferably about one-eighth inch. The crease 12 preferably projects from the outside surface 20 a height of approximately 0.020 inches.

The strip 11 is preferably made from a filled polyolefin composition in which the mineral is a silicate mineral, such as one of the following: talc, montmorillonite, kaolin, calcined kaolin, wallstonite, mica, asbestos, chrysotile, tremolite, crocidolyte, homblende and/or attapulgite. An example of a suitable material is a mineral filled polypropylene supplied by Ferro as product TTP-40AA-AZ. This material has been found to adhere well both to sprayable construction adhesives and drywall compound. It is important for the strip to adhere well to both such materials because of construction techniques which are commonly used. For example, drywall installers may use a spray adhesive at a joint in lieu of nails, screws or staples to attach the strip at a corner or a butt joint. An example of a sprayable adhesive is a product sold by Came-Campbell Construction Products, under the name Came-343 Construction Adhesive. This adhesive is a fast tack adhesive which is specially formulated to bond polyethylene to various materials. Once the strip or corner bead has been placed onto the tackified drywall sheets, coats of drywall compound may be thereafter applied.

FIG. 5 shows how the knurls adjacent to a perforation 14 allow a portion of the drywall mud to reach the inside surface 22 of the strip 11 to enhance the strength of the joint formed by the strip and hardened by the drywall compound. The knurls, which are preferably imparted to the inside surface by the formation of the depressions 16 on the outside surface, are preferably at intervals at approximately 0.05 inches. The knurls 18 give the inside surface of the strip a rough surface which enhances the ability of the strip to adhere well to a drywall sheet which has been sprayed with an adhesive. In the alternative, if an adhesive is not used but a coating of drywall compound or fasteners of some kind are used, the depressions 16 on the outside surface of the strip improve the adhesion of the drywall compound to the outside surface 20 of the strip.

The use of a mineral filled polyolefin, such as polypropylene, has several advantages. The cost of such materials is relatively low compared to the cost of PVC. In addition, mineral filled polyolefins, such as mineral filled polypropylene, can be extruded in widths of several inches up to even a few feet in width. This enables a relatively low manufacturing cost for the sheet itself. After wide widths of the mineral filled polyolefin have been extruded, the sheets can then be slit into appropriate widths, for example, a strip of approximately 2 and one-half inches. Once a strip of appropriate final width has been cut from a wider strip of material, the crease 12, perforations 14, depressions 16 and knurls 18 can all be formed in a simple rolling operation. In addition, one or both of the inside and outside surfaces 20 and 22 may be corona treated, particularly if a mineral filled polypropylene material is used, to improve the wettability and therefore adhesion characteristics of the strip. It is also worth noting that by using a mineral filled polyolefin, such as a talc filled polypropylene, a roll 10 such as is shown in FIG. 2 will be lighter in weight than a comparably sized PVC roll, a 0.025 by 2-½ inch wide, strip.

Another advantage of using a polymer strip is that it may be corona treated to make it more suitable for construction adhesives to adhere thereto. Corona surface treating polymer-based materials increases the surface wettability of such materials. It is accomplished by exposing the surfaces to a high-frequency, electrical discharge. Such treatment is sometimes needed in order for inks, adhesives or coatings to adhere well to certain polymers, if the surface energy of the polymer-based materials is lower than the surface energy of the inks, coatings, etc. for which adhesion is desired. Corona surface treating does not affect the material bulk properties, such as the strength or the appearance of the polymer. The corona treatment is achieved by applying a high frequency voltage between electrodes. The electrons present in the air gap are accelerated and ionize the air gap. The polymer surfaces placed in this field receive electron impacts which have 2 to 3 times the energy required to break the molecular bonds found on those surfaces. Oxygen reacts with the free radicals formed by such breakage, rapidly producing chemical functional groups on the surface. These groups are most effective at increasing the surface energy and enhancing bonding to the polymer surface.

The strip of the present invention, because it is easily transported in roll form and is light weight, is particularly suitable for use in repairing drywall. Electricians and other tradesman are often required to gain access to the interior portions of a wall constructed with drywall sheets. In the process of gaining such access, it is not uncommon for damage to occur at interior, exterior and butt joints of drywall sheets. The present invention allows quick and highly effective repairs to be made with materials that are easily stored and transported from site to site. By carrying a small can of spray adhesive, a roll of strip made in accordance with the present invention, and a small container of drywall compound (dry form or pre-mixed), a repair to a joint in a drywall construction can be made quickly and easily by using the present invention.

While the invention claimed below has been explained with reference to specific examples and embodiments, the invention is not limited to the specific forms shown and described. Indeed, it is expected that alternatives, modifications and improvements may be made while still incorporating the present invention as expressed in the following claims.

What is claimed is:

1. A corner bead for drywall construction and repair comprising:

a flat strip of material with a crease extending lengthwise down the center of said strip from one end of said sheet to the other, said crease providing said strip with a capability of being bent to a 90 degree angle about said crease, said strip having a first inner surface and a second outer surface on opposite ends of said sheet, said material being a mineral filled polymer rendering said-first and second surfaces receptive to adhesives used in drywall construction.

2. A corner bead for drywall construction and repair in accordance with claim 1 wherein:

said crease is a projection extending outwardly from said first outer surface of said strip, said strip having perforations extending from said first surface through said strip to said second surface.

3. A corner bead for drywall construction and repair in accordance with claim 1 wherein:

said outer surface of said strip has depressions formed therein, said depressions forming complementary protrusions on said first inner surface, said protrusions forming channels between said protrusions, whereby drywall compound may flow through said perforations and into said channels when said corner bead is placed over abutting pieces of drywall.

4. A corner bead for drywall construction and repair comprising: a flat strip with a crease extending lengthwise down the center of said strip from one end to the other, said crease providing said strip with the capability of being bent to at least about a 90 degree angle about said crease, said strip having a first inner surface and a second outer surface on opposite sides of said strip, said strip being made of mineral filled polymer, said mineral filled polymer is one which renders said first and second surfaces receptive to adhesives used in drywall construction and is selected from the group consisting of: mineral filled polyolefin, mineral filled vinyl, and corona treated mineral filled polyolefin, said crease being a projection extending outwardly from said second outer surface of said strip, said strip having perforations extending from said first inner surface through said strip to said second outer surface, said second outer surface of said strip having depressions formed therein, said depressions forming complementary protrusions on said first inner surface, said protrusions forming channels between said protrusions, whereby drywall compound may flow through said perforations and into said channels when said corner bead is placed over abutting pieces of drywall.

5. A corner bead for drywall construction and repair in accordance with claim 4 wherein:

said polymer is a mineral filled polyolefin and contains a filler selected from the group consisting of: talc, montmorillonite, kaolin, calcined kaolin, wollastonite, mica, asbestos, chrysotile, tremolite, crocidolyte, homblende, attapulgite and combinations thereof.

6. A corner bead for drywall construction and repair in accordance with claim 1 wherein at least one of said first and second surfaces of said polymer has been corona treated to increase the wettability of said surface.

7. A corner bead for drywall construction and repair comprising: a flat strip with a crease extending lengthwise down the center of said strip from one end of said strip to the other, said crease providing said strip with a capability of being bent to at least a 90 degree angle about said crease, said strip having a first inner surface and a second outer surface on opposite sides of said strip, said strip being made of mineral filled polymer, said crease being a projection extending outwardly from said second outer surface of said strip, said strip having perforations extending from said first surface through said strip to said second surface, said strip having means for allowing drywall compound to flow from one side of said strip to the other after said strip has been attached to two adjacent pieces of drywall.

8. A corner bead for drywall construction and repair in accordance with claim 7 wherein:

said outer surface of said strip has a plurality of depressions formed therein in areas adjacent to at least some of said perforations, said depressions forming complementary protrusions on said first inner surface, said protrusions forming channels between said protrusions, whereby drywall compound may flow through said perforations and into said channels when said corner bead is placed over abutting pieces of drywall.

9. A corner bead for drywall construction and repair in accordance with claim 8 wherein at least one of said first and second surfaces of said strip has been corona treated to increase the wettability of said surface.

* * * * *